US008581810B2

(12) United States Patent
Dhayagude et al.

(10) Patent No.: US 8,581,810 B2
(45) Date of Patent: Nov. 12, 2013

(54) METHODS AND CIRCUITS FOR SELF-CALIBRATING CONTROLLER

(75) Inventors: Tushar Dhayagude, Santa Clara, CA (US); Hendrik Santo, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 801 days.

(21) Appl. No.: 12/145,414

(22) Filed: Jun. 24, 2008

(65) Prior Publication Data

US 2009/0231247 A1 Sep. 17, 2009

Related U.S. Application Data

(63) Continuation-in-part of application No. 12/046,280, filed on Mar. 11, 2008, and a continuation-in-part of application No. 12/111,114, filed on Apr. 28, 2008.

(51) Int. Cl.
*G09G 3/32* (2006.01)
*G09G 5/10* (2006.01)

(52) U.S. Cl.
USPC ..... 345/82; 345/102; 345/690; 315/169.3

(58) Field of Classification Search
USPC ..... 345/87–104, 204, 690, 76–83; 315/169.3
See application file for complete search history.

(56) References Cited

U.S. PATENT DOCUMENTS 5,315,214 A 5/1994 Lesea
5,722,040 A 2/1998 Bjerede et al.
6,172,556 B1 1/2001 Prentice
6,593,709 B2 7/2003 Lee et al.
6,633,138 B2 10/2003 Shannon et al.
7,339,471 B1 3/2008 Chan et al.
7,583,035 B2 9/2009 Shteynberg et al.
8,044,919 B2 10/2011 Song et al.
8,072,444 B2 12/2011 Ikeda et al.
8,144,106 B2 3/2012 Kim
2002/0145041 A1 10/2002 Muthu et al.

(Continued)

FOREIGN PATENT DOCUMENTS

CN 201114961 9/2008
WO WO2009016588 A1 2/2009

OTHER PUBLICATIONS

International Search Report and Written Opinion for PCT Application No. PCT/US2009/035334 dated Apr. 28, 2009, 10 pages.

(Continued)

*Primary Examiner* — Stephen Sherman
(74) *Attorney, Agent, or Firm* — Fish & Richardson P.C.

(57) ABSTRACT

The present invention relates to circuits and methods for controlling one or more LEDs or LED drivers. The circuit comprises a programmable decentralized controller coupled to one or more detectors, wherein the one or more detectors are configured to detect one or more measurable parameters of one or more LEDs or LED drivers. The controller is configured to receive information from the one or more detectors related to the one or more measurable parameters. The controller is also configured to adjust one or more controllable parameters until one or more detectors indicate that one or more measurable parameters in one of the LEDs or LED drivers meet a reference condition. The controller is configured to then set one or more of the controllable parameters to operate at a value relative to the value of the controllable parameters at which the reference condition was met.

24 Claims, 7 Drawing Sheets

(56) References Cited

U.S. PATENT DOCUMENTS

| | | | | |
|---|---|---|---|---|
| 2004/0051684 | A1* | 3/2004 | Ishizuka | 345/76 |
| 2004/0105264 | A1 | 6/2004 | Spero | |
| 2005/0184708 | A1 | 8/2005 | Pipen et al. | |
| 2006/0022214 | A1 | 2/2006 | Morgan et al. | |
| 2006/0033536 | A1 | 2/2006 | Thelen et al. | |
| 2006/0214603 | A1 | 9/2006 | Oh et al. | |
| 2007/0040512 | A1 | 2/2007 | Jungwirth et al. | |
| 2007/0075958 | A1 | 4/2007 | Kim et al. | |
| 2007/0091067 | A1 | 4/2007 | Elsheimer et al. | |
| 2007/0126690 | A1* | 6/2007 | Chae | 345/102 |
| 2007/0139319 | A1* | 6/2007 | Nishida et al. | 345/83 |
| 2007/0273299 | A1 | 11/2007 | Miskin et al. | |
| 2007/0285133 | A1 | 12/2007 | Dickman et al. | |
| 2008/0042045 | A1 | 2/2008 | Miyazawa | |
| 2008/0084222 | A1 | 4/2008 | Yen | |
| 2008/0170012 | A1* | 7/2008 | S et al. | 345/82 |
| 2008/0191631 | A1 | 8/2008 | Archenhold et al. | |
| 2008/0224629 | A1 | 9/2008 | Melanson | |
| 2008/0278097 | A1 | 11/2008 | Roberts et al. | |
| 2008/0309611 | A1* | 12/2008 | Yang | 345/102 |
| 2009/0042526 | A1* | 2/2009 | Maulik et al. | 455/234.1 |
| 2009/0079362 | A1 | 3/2009 | Shteynberg et al. | |
| 2009/0128045 | A1 | 5/2009 | Szczeszynski et al. | |
| 2009/0179589 | A1 | 7/2009 | Buhler et al. | |
| 2009/0184904 | A1* | 7/2009 | S. et al. | 345/82 |
| 2009/0224736 | A1* | 9/2009 | Santo et al. | 323/274 |
| 2009/0230882 | A1 | 9/2009 | Santo et al. | |
| 2009/0267652 | A1 | 10/2009 | Santo et al. | |
| 2009/0315467 | A1 | 12/2009 | Schindler et al. | |
| 2010/0013395 | A1 | 1/2010 | Archibald et al. | |
| 2010/0188443 | A1* | 7/2010 | Lewis et al. | 345/691 |
| 2010/0237786 | A1* | 9/2010 | Santo et al. | 315/185 R |

OTHER PUBLICATIONS

International Search Report and Written Opinion for PCT Application No. PCT/US2009/048505 dated Jul. 31, 2009, 10 pages.

International Search Report and Written Opinion for PCT Application No. PCT/US2009/048769 dated Sep. 1, 2009, 10 pages.

International Search Report and Written Opinion for PCT Application No. PCT/US2009/053777 dated Nov. 5, 2009, 11 pages.

Chinese Office Action dated Nov. 12, 2012for Application No. 200980124407.2, 54 pages.

International Preliminary Report on Patentability; BAI; Jul. 12, 2012; World Intellectual Property Organization (WIPO) (International Bureau Of); 20275-0168WO1; 7 pages.

International Search Report and Written Opinion; Pitard /Henderson; Jul. 6, 2011; World Intellectual Property Organization (WIPO) (International Bureau Of); PCT/US2010/061011 ; 10 pages.

* cited by examiner

METHODS AND CIRCUITS FOR SELF-CALIBRATING CONTROLLER

The present application is a continuation in part of U.S. patent application Ser. No. 12/046,280, filed Mar. 11, 2008; and U.S. patent application Ser. No. 12/111,114, filed Apr. 28, 2008; which are incorporated herein by reference in their entirety.

FIELD OF INVENTION

The present invention relates to light emitting diode ("LED") strings for backlighting electronic displays and/or other electronics system. More particularly, the present invention relates to circuits and methods for efficiently controlling LEDs and LED drivers based on parameters such as voltage, current, power, temperature, light intensity, and wavelength.

BACKGROUND OF THE INVENTION

Backlights are used to illuminate liquid crystal displays ("LCDs"). LCDs with backlights are used in small displays for cell phones and personal digital assistants ("PDAs") as well as in large displays for computer monitors and televisions. Often, the light source for the backlight includes one or more cold cathode fluorescent lamps ("CCFLs"). The light source for the backlight can also be an incandescent light bulb, an electroluminescent panel ("ELP"), or one or more hot cathode fluorescent lamps ("HCFLs").

The display industry is enthusiastically pursuing the use of LEDs as the light source in the backlight technology because CCFLs have many shortcomings: they do not easily ignite in cold temperatures, they require adequate idle time to ignite, and they require delicate handling. Moreover, LEDs generally have a higher ratio of light generated to power consumed than the other backlight sources. Because of this, displays with LED backlights can consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes seven LEDs 4, 5, 6, 7, 8, 9 and 11 discretely scattered across the display 10 and connected in series. The first string 1 is controlled by the drive circuit or driver 12. The second string 2 is controlled by the drive circuit 13 and the third string 3 is controlled by the drive circuit 14. The LEDs of the LED strings 1, 2 and 3 can be connected in series by wires, traces or other connecting elements.

FIG. 2 shows another exemplary flat panel display 20 with a backlighting system having three independent strings of LEDs 21, 22 and 23. In this embodiment, the strings 21, 22 and 23 are arranged in a vertical fashion. The three strings 21, 22 and 23 are parallel to each other. The first string 21 includes seven LEDs 24, 25, 26, 27, 28, 29 and 31 connected in series, and is controlled by the drive circuit, or driver, 32. The second string 22 is controlled by the drive circuit 33 and the third string 23 is controlled by the drive circuit 34. One of ordinary skill in the art will appreciate that the LED strings can also be arranged in a horizontal fashion or in another configuration.

There are many parameters in an LED string that can be controlled to optimize the efficiency or/and other operating targets of an LED string and driver, including temperature, luminous intensity and color, current and voltage. For example, current is an important feature for displays because the current in the LEDs controls the brightness or luminous intensity of the LEDs. The intensity of an LED, or luminosity, is a function of the current flowing through the LED. FIG. 3 shows a representative plot of luminous intensity as a function of forward current for an LED. As the current in the LED increases, the intensity of the light produced by the LED increases. The current in the LEDs must be sufficiently high provided the desired brightness, but to operate efficiently and avoid excess power dissipation, the current should not be too high.

SUMMARY OF THE INVENTION

The present invention relates to circuits and methods for controlling one or more LEDs or LED drivers. The circuit comprises a programmable decentralized controller coupled to one or more detectors, wherein the one or more detectors are configured to detect one or more measurable parameters of one or more LEDs or LED drivers. The controller is configured to receive information from the one or more detectors related to the one or more measurable parameters. The controller is also configured to adjust one or more controllable parameters until one or more detectors indicate that one or more measurable parameters in one of the LEDs or LED drivers meet a reference condition. The controller is configured to then set one or more of the controllable parameters to operate at a value relative to the value of the controllable parameters at which the reference condition was met.

The present invention also includes a method for controlling one or more LEDs or LED drivers. The method comprises detecting one or more measurable parameters of the one or more LEDs or LED drivers; receiving information from the one or more detectors related to the one or more measurable parameters; adjusting one or more controllable parameters of the one or more LEDs or LED drivers until the measurable parameters in the one or more LEDs or LED drivers meet a reference condition; and setting the controllable parameters to operate at a value relative to the value of the controllable parameters at which the reference condition was met, wherein the setting is performed by a programmable decentralized controller.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

The present invention relates to circuits and methods for controlling one or more LEDs or LED drivers. The circuit comprises a programmable decentralized controller coupled to one or more detectors, wherein the one or more detectors are configured to detect one or more measurable parameters of one or more LEDs or LED drivers. The controller is configured to receive information from the one or more detectors related to the one or more measurable parameters. The controller is also configured to adjust one or more controllable parameters until one or more detectors indicates that one or more measurable parameters in one of the LEDs or LED drivers meet a reference condition. The controller is configured to then set one or more of the controllable parameters to operate at a value relative to the value of the controllable parameters at which the reference condition was met.

The present invention also includes a method for controlling one or more LEDs or LED drivers. The method comprises detecting one or more measurable parameters of the one or more LEDs or LED drivers; receiving information from the one or more detectors related to the one or more measurable parameters; adjusting one or more controllable parameters of the one or more LEDs or LED drivers until the measurable parameters in the one or more LEDs or LED drivers meet a reference condition; and setting the controllable parameters to operate at a value relative to the value of the controllable parameters at which the reference condition was met, wherein the setting is performed by a programmable decentralized controller.

As used herein, the term "relative to" means that a value A established relative to a value B signifies that A is a function of the value B. The functional relationship between A and B can be established mathematically or by reference to a theoretical or empirical relationship. As used herein, coupled means directly or indirectly connected in series by wires, traces or other connecting elements. Coupled elements may receive signals from each other.

Figure 1:
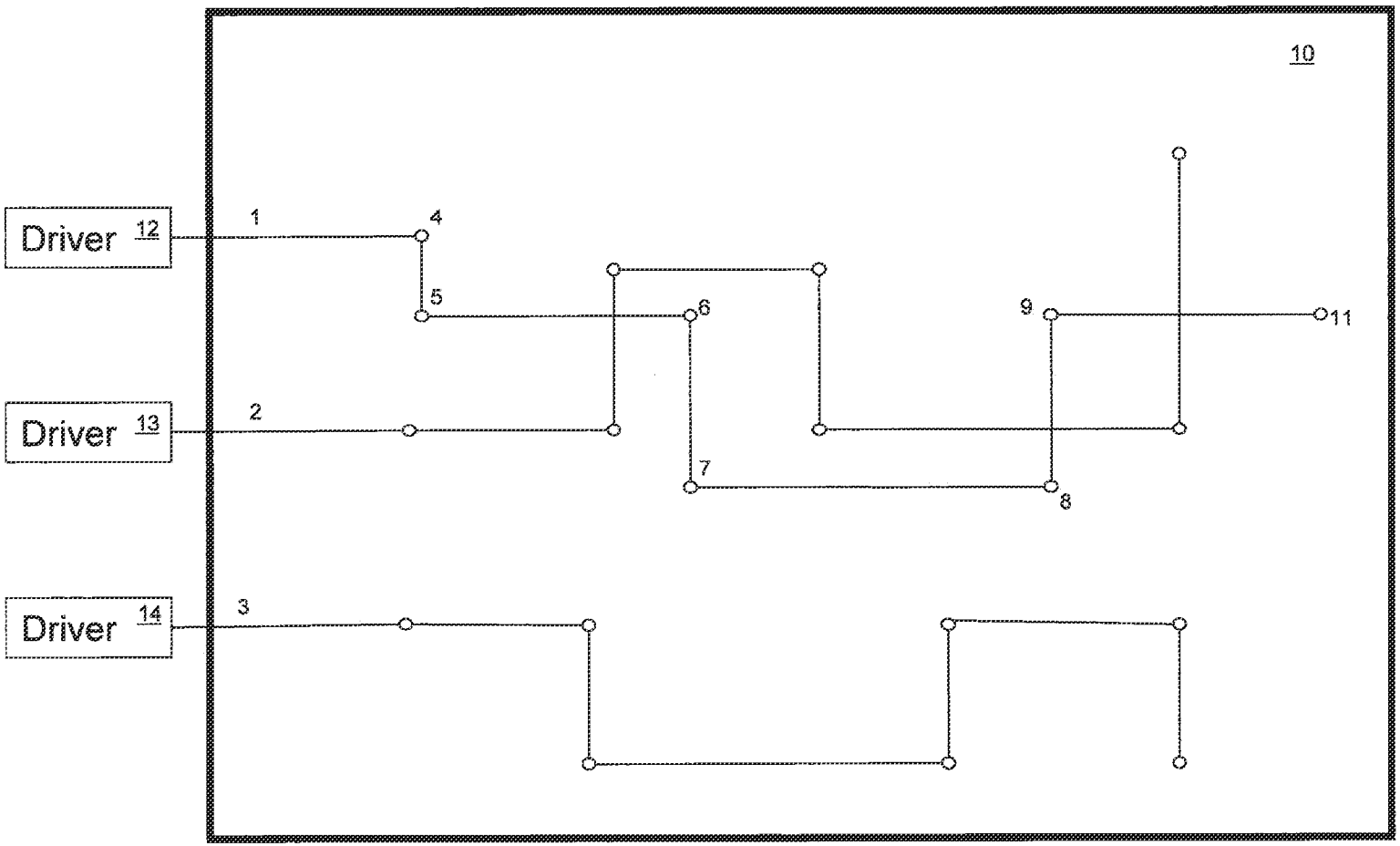
FIG. 1 PRIOR ART
FIG. 1 illustrates an exemplary display implementing LED strings.
Figure 2:
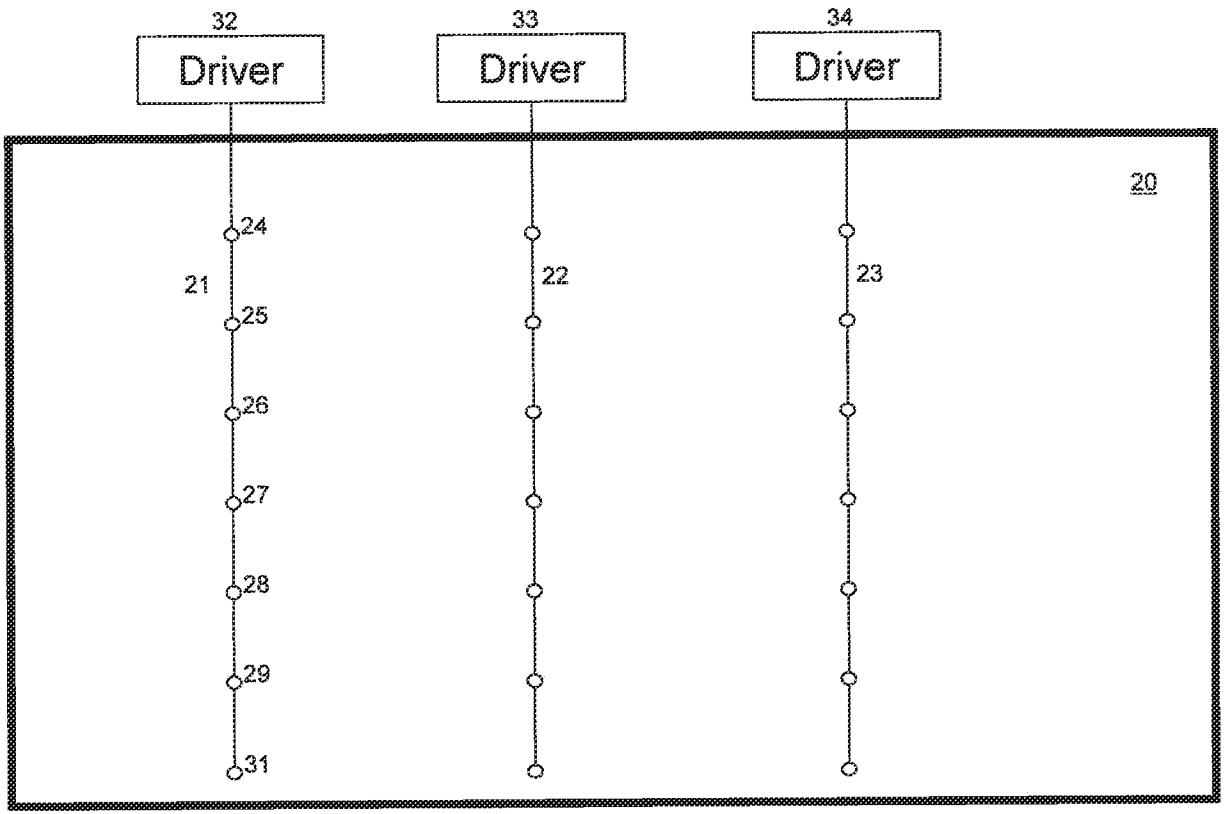
FIG. 2 PRIOR ART
FIG. 2 illustrates another exemplary display implementing LED strings.
Figure 3:
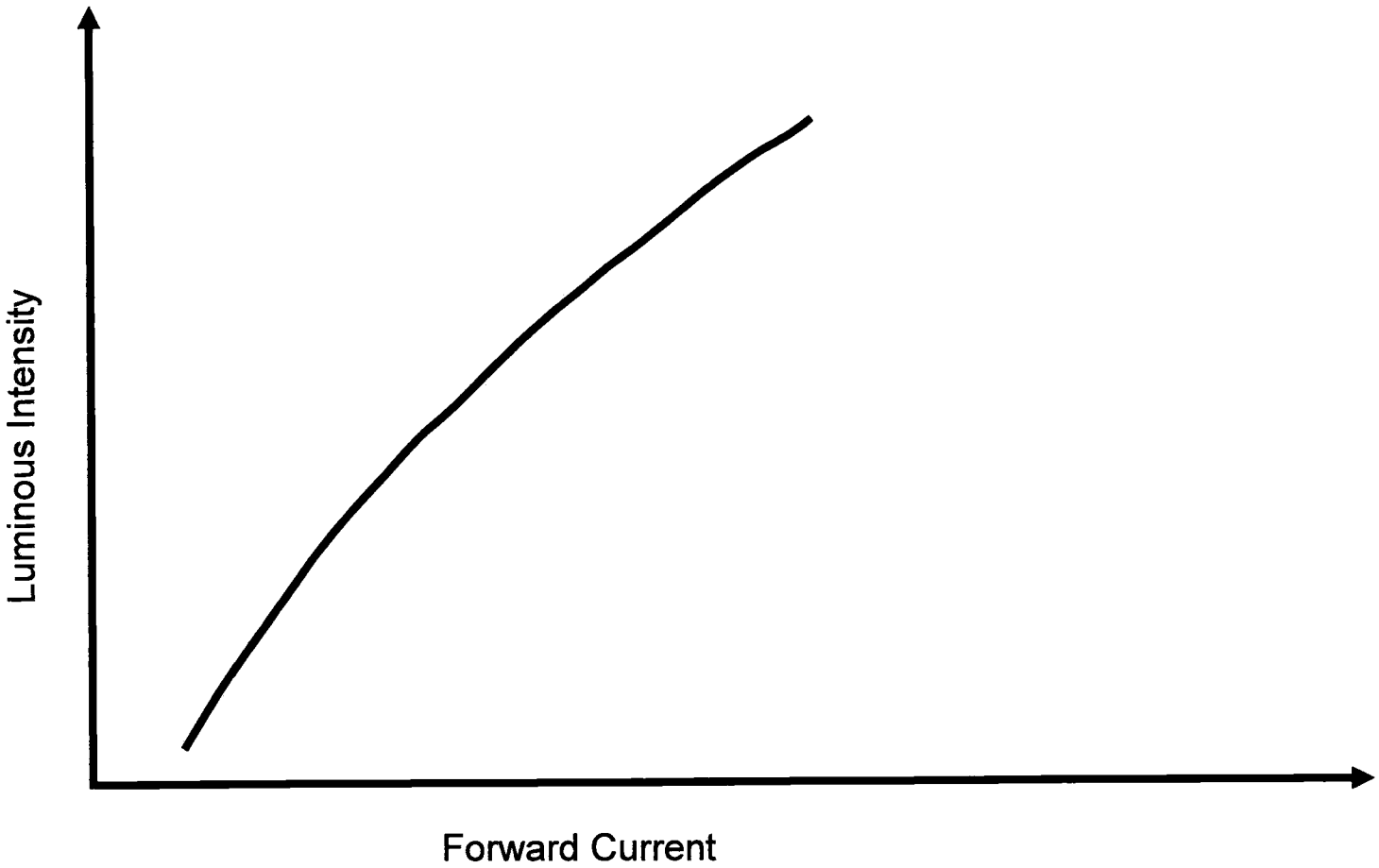
FIG. 3 illustrates a graph showing the relationship between current and luminous intensity in an LED.
Figure 4:
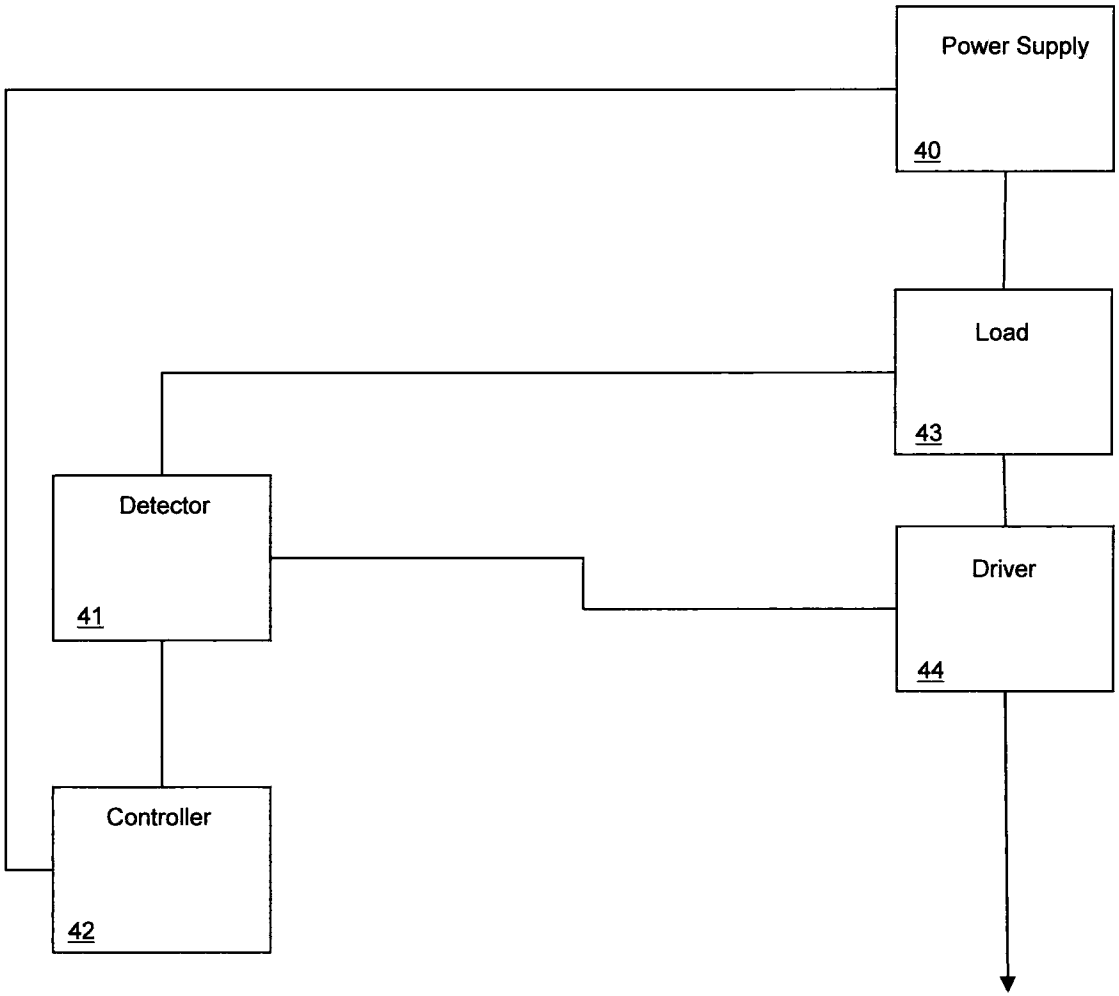
FIG. 4 illustrates a use of an embodiment of the controller of the present invention.

FIG. 4 illustrates a configuration in which the circuit 42 for controlling at least one parameter in a load 43 or load driver 44 of the present invention can be used. The load 43 can be a string or array of LEDs and the driver 44 can be a driver for an LED string or array. In FIG. 4, a detector 41 is coupled to the load 43 and/or the driver 44. The detector 41 detects measurable parameters in the load 43 and/or driver such as temperature, voltage, current, luminous intensity, or luminous wavelength distribution or color. The triode region detector of U.S. patent application Ser. No. 12/111,114, the full disclosure of which is herein incorporated by reference, is an example of a detector that can be used with the controller 42 of the present invention. The load 43 is coupled to a power supply 40 that provides the drive voltage for the LED string 43. The load 43 is also coupled to a driver 44 that regulates the operation of the load 43. The controller 42 is coupled to the power supply 40 such that the controller 42 can control the drive voltage from the power supply 40. As shown in FIG. 4, the programmable controller 42 of the present invention is decentralized. That is, the controller 42 is not a necessary part of the control loop of the power supply loop, but it can influence the power supply loop. In the example of FIG. 4, the power supply 40 can be initiated and the driver 44 can bring the load 43 to a set operating condition without any interaction from the programmable decentralized controller 42. Therefore, the driver loop comprising the power supply 40, the load 43, and the driver 44 can operate independently of the controller 42. However, at the occurrence of some event or the passage of some interval, the programmable decentralized controller can adjust the operation of the driver loop to calibrate and/or optimize a parameter of the driver loop.

In the following example, the detector 41 is a triode region detector. However, this is merely exemplary and is not limiting. In the case where the detector 41 is a triode region detector coupled to an LED driver 44, the controller 42 is configured to control the driver 44 and/or the power supply 40 to step the drive voltage down until the triode region detector 41 sets the triode region flag. The controller 42 then causes the power supply 40 and or the driver 44 to operate at a drive voltage some programmable level above the drive voltage at which the triode flag was set. The controller 42 causes to power supply 40 and/or the driver 44 to set the drive voltage sufficiently high to avoid operation in the triode region, thereby optimizing power dissipation in the circuit and improving circuit efficiency.

In the above example, the controller 42 caused the power supply 40 and/or the driver 44 to step down the drive voltage. However, in the controller 42 can also cause the power supply 40 and/or the driver 44 to step up the drive voltage according to the desired application for the controller 42. Also, the controller 42 can control some other controllable parameter such as current, power, or resistance depending on the application. Also, in addition to the controller 42 causing the drive voltage to step up or step down, the controller 42 can wait until the drive voltage or other controllable parameter is increased or decreased until a reference condition is met. Moreover, in the above example, the controller 42 causes the power supply 40 and/or the driver 44 to set the drive voltage sufficiently high to avoid operating in the triode region. Depending on the application of the controller 42, the controller 42 can cause the power supply 40 and/or the driver 44 to set the drive voltage at any point relative to drive voltage at which the reference condition, as detected by the detector 41, is met. The reference condition can be a constant offset from the detected parameter such that the reference condition is met when the detected parameter is within a positive or negative constant from some reference for the detected parameter. The reference condition can be a function of the detected parameter and a reference parameter. The reference condition can also be a function of multiple measured parameters such as a combination of voltage, wavelength and intensity.

Figure 5:
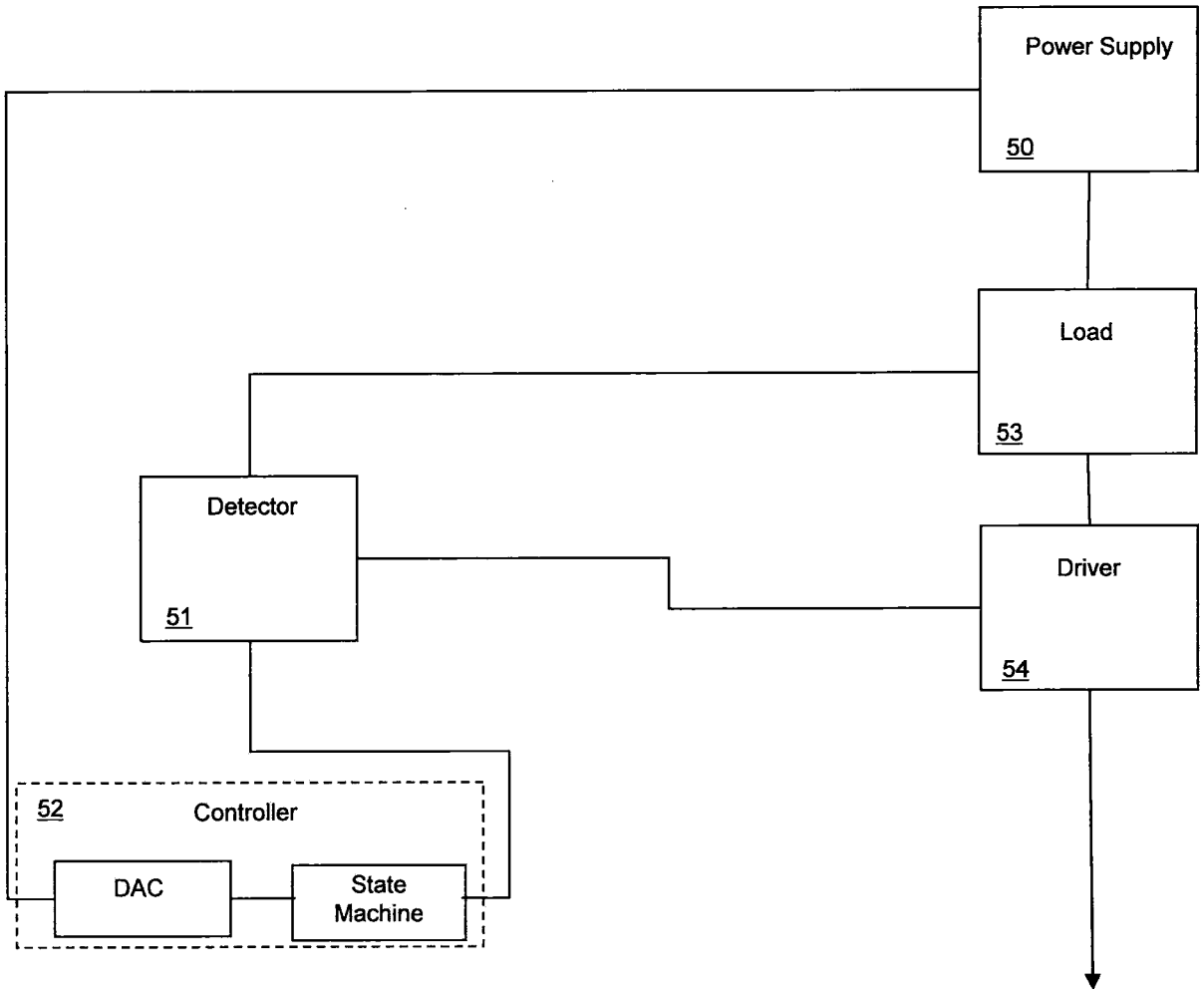
FIG. 5 illustrates a use of an embodiment of the controller of the present invention.

As show in FIG. 5, the controller 52 can comprise a digital-to-analog converter ("DAC") and a state machine in one embodiment. The programmable controller of the present invention can be programmable and may be implemented in analog, digital or some combination of these devices and in hardware, software, firmware, or some combination of these media.

Figure 6:
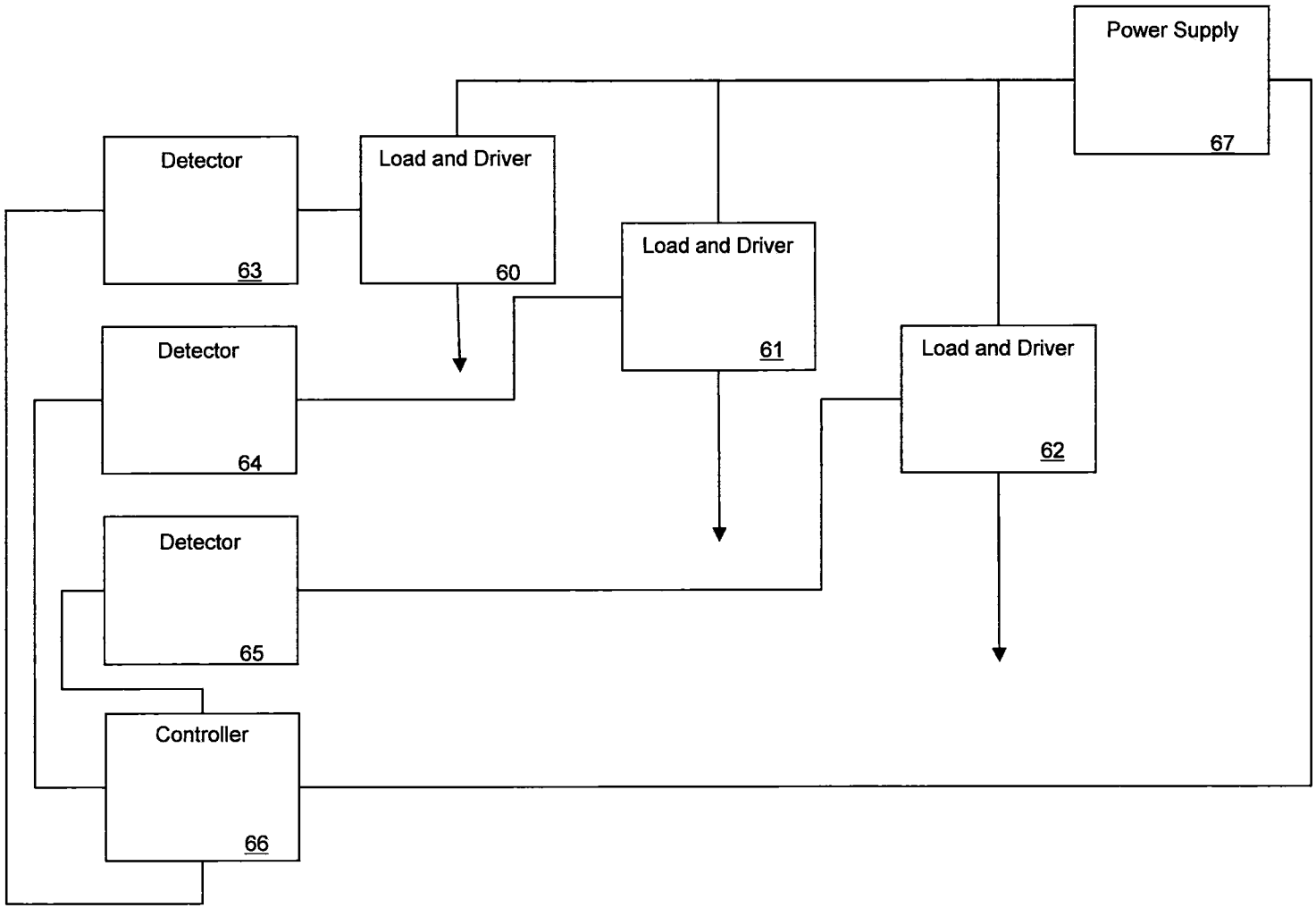
FIG. 6 illustrates a use of an embodiment of the controller of the present invention.

As shown in FIG. 6, the programmable decentralized controller 66 can be coupled to one or more detectors 63, 64, 65 which are coupled to one or more loads and drivers 60, 61, 62. In this embodiment, the power supply 67 is coupled to one or more loads and drivers 60, 61, 62. The controller 66 operates as discussed above, causing the power supply 67 and/or the drivers 60, 61, 62 to adjust a controllable parameter until at least one of the detectors 63, 64, 65 detects that a reference condition is met in the loads and/or drivers 60, 61, 62 to which the detector is coupled. The controller 66 can cause the power supply 67 and/or drivers 60, 61, 62 to operate at a setting of the controllable parameter relative to the value of the controllable parameter at which the reference condition in at least one of the loads or drivers 60, 61, 62 was met. The trigger that the controller 66 uses to cause the power supply 67 and/or drivers 60, 61, 62 to set the controllable parameter can be detection that the reference condition is met in one of the loads or drivers 60, 61, 62 or the trigger can be some combination of the reference condition being met in more than one of the loads or drivers 60, 61, 62. The controller 66 can include a delay from the time the reference condition in one or more of the loads or drivers 60, 61, 62 is met to the time the controllable parameter is set.

Figure 7:
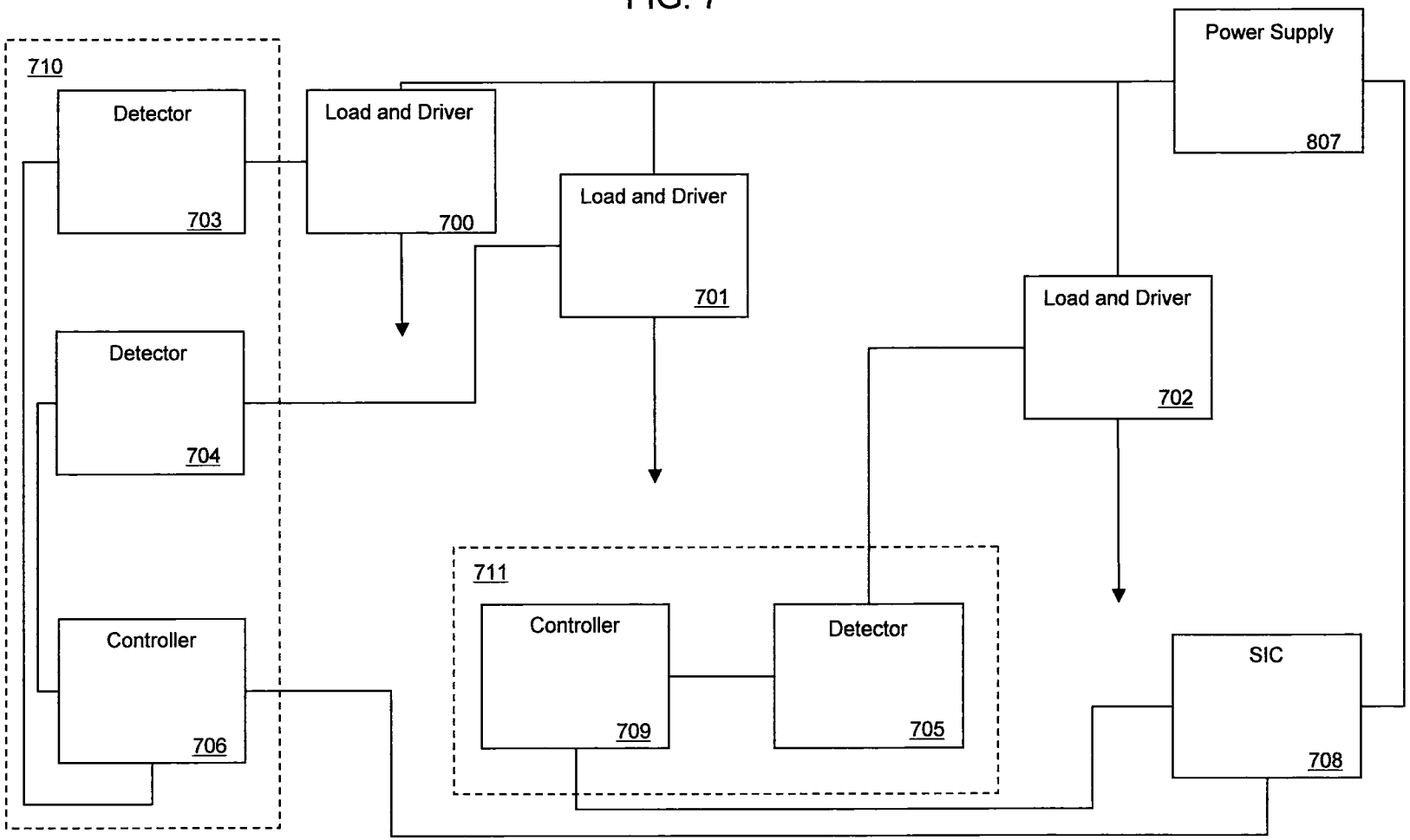
FIG. 7 illustrates a use of an embodiment of the controller of the present invention.

As shown in FIG. 7, the controller 706 of the present invention can be used in conjunction with one or more other controllers 709. In the example of FIG. 7, an integrated circuit chip 710 comprises the controller 706 and detectors 703, 704. The integrated circuit chip 710 can also comprise a controller 709, a detector 705, and a driver 702. A second integrated circuit chip 711 comprises the controller 709 and detector 705. The detectors 703, 704, 705 are coupled to loads and drivers 700, 701, 702 respectively. The loads and drivers 700, 701, 702 are coupled to a power supply 707. The controllers 706, 709 can be coupled to a system for inter-chip communication ("SIC") 708 such as that disclosed in U.S. patent application Ser. No. 12/046,280, the entire disclosure of which is herein incorporated by reference. When the detectors 703, 704, 705 detect that a reference condition is met in one of the respective loads and/or drivers 700, 701, 702, or in some combination of the respective loads and drivers 700, 701, 702, at least one of the controllers 706, 709 causes the power supply 707 to set the controllable parameter in the loads and drivers 700, 701, 702.

The controller can set the controllable parameter at some regular or adjustable interval or upon certain events such as at initial start up to or upon some system parameter changes. The controller can initiate the adjusting of the controllable parameters relative to a change in a second measurable parameter in at least one of the one or more loads and/or drivers. The second measurable parameter can be the same as the measurable parameter that is detected the detectors, or it can be different measurable parameter. The controller can be integrated in a liquid crystal display with LEDs.

One of ordinary skill in the art will appreciate that the techniques, structures and methods of the present invention above are exemplary. The present inventions can be implemented in various embodiments without deviating from the scope of the invention.

The invention claimed is:

1. A circuit comprising:

one or more LED drivers configured for coupling to one or more LEDs and configured to regulate operation of the one or more LEDs, wherein the LED drivers are configured to receive a drive voltage from a power supply;

a programmable decentralized controller coupled to the power supply and one or more detectors, wherein the one or more detectors are configured to detect one or more measurable parameters of the one or more LEDs or LED drivers;

said controller configured to control the power supply to set the drive voltage;

said controller configured to receive information from the one or more detectors related to the one or more measurable parameters;

said controller configured to adjust one or more controllable parameters until one or more detectors indicate that one or more measurable parameters in one of the LEDs or LED drivers meet a reference condition; and said controller configured to set one or more of the controllable parameters to operate at a value relative to the value of the controllable parameters at which the reference condition was met.

2. The circuit of claim 1, wherein the one or more detectors detect the ambient temperature of at least one of the LEDs or LED drivers.

3. The circuit of claim 1, wherein the one or more detectors detect the current in at least one of the LEDs or LED drivers.

4. The circuit of claim 1, wherein the one or more detectors detect a voltage in at least one of the LEDs or LED drivers.

5. The circuit of claim 1, wherein the one or more detectors detect a luminous intensity of at least one of the LEDs.

6. The circuit of claim 1, wherein the one or more detectors detect a wavelength of the light emitted by at least one of the LEDs.

7. The circuit of claim 1, wherein the controller initiates the adjusting of the controllable parameters relative to the start up of at least one of the one or more LEDs or LED drivers.

8. The circuit of claim 1, wherein the controller initiates the adjusting of the controllable parameters relative to a change in a second measurable parameter in at least one of the one or more LEDs or LED drivers.

9. The circuit of claim 1, wherein the controller initiates the adjusting of the controllable parameters at a fixed or variable time interval.

10. The circuit of claim 1, wherein the controller comprises a DAC and a state machine.

11. A liquid crystal display comprising the circuit of claim 1.

12. The circuit of claim 1, wherein the one or more detectors comprise one or more triode region detectors.

13. The circuit of claim 1, wherein the programmable decentralized controller is not necessary for the operation of the one or more LEDs or LED drivers, and the one or more LEDs or LED drivers can operate independent of the programmable decentralized controller.

14. The circuit of claim 1, wherein the programmable decentralized controller is configured to control the power supply to set the driver voltage at any value relative to the drive voltage at which the reference condition, as detected by the one or more detectors, is met.

15. The circuit of claim 1, further comprises a second programmable decentralized controller coupled to a second set of one or more detectors, wherein the second set of one or more detectors is configured to detect a second set of one or more measurable parameters of a second set of one or more LEDs or LED drivers, wherein the power supply is coupled to the second set of one or more LEDs and provides second drive voltage for the second set of one or more LEDs, wherein the second programmable decentralized controller is configured to control the power supply to set the second drive voltage, and wherein the programmable decentralized controller and the second programmable decentralized controller are coupled to the power supply through a system for inter-chip communication.

16. A method for controlling one or more LEDs or LED drivers by a programmable decentralized controller, the method comprising:

detecting one or more measurable parameters of the one or more LEDs or LED drivers;

receiving information from the one or more detectors related to the one or more measurable parameters;

adjusting one or more controllable parameters of the one or more LEDs or LED drivers until the measurable parameters in the one or more LEDs or LED drivers meet a reference condition;

setting the controllable parameters to operate at a value relative to the value of the controllable parameters at which the reference condition was met, wherein the setting is performed by a programmable decentralized controller; and setting a driver voltage for the one or more LEDs by controlling a power supply coupled to the programmable decentralized controller, wherein the power supply provides the driver voltage for the one or more LEDs.

17. The method of claim 16, wherein the reference condition is based on the ambient temperature of at least one of the LEDs or LED drivers.

18. The method of claim 16, wherein the reference condition is based on the current in at least one of the LEDs or LED drivers.

19. The method of claim 16, wherein the reference condition is based on a voltage in at least one of the LEDs or LED drivers.

20. The method of claim 16, wherein the reference condition is based on a luminous intensity of at least one of the LEDs.

21. The method of claim 16, wherein the reference condition is based on a wavelength of the light emitted by at least one of the LEDs.

22. The method of claim 16, wherein the adjusting of the controllable parameters is initiated relative to at least one of the start up of at least one of the LEDs or LED drivers or a change in parameters in at least one of the LEDs or LED drivers.

23. The method of claim 16, wherein the adjusting of the controllable parameters is initiated relative to a fixed or variable time interval.

24. A circuit for controlling one or more LEDs or LED drivers comprising:

a programmable decentralized controller coupled to a power supply and one or more detectors, wherein the power supply provides a drive voltage for the one or more LEDs, and wherein the one or more detectors are configured to detect one or more measurable parameters of the one or more LEDs or LED drivers, wherein the one or more LEDs or LED drivers are configured to operate independent of the programmable decentralized controller;

said controller configured to control the power supply to set the drive voltage;

said controller configured to receive information from the one or more detectors related to the one or more measurable parameters;

said controller configured to adjust one or more controllable parameters until one or more detectors indicate that one or more measurable parameters in one of the LEDs or LED drivers meet a reference condition; and said controller configured to set one or more of the controllable parameters to operate at a value relative to the value of the controllable parameters at which the reference condition was met.

* * * * *